US006223506B1

(12) United States Patent
Ghini et al.

(10) Patent No.: US 6,223,506 B1
(45) Date of Patent: May 1, 2001

(54) METHOD AND MACHINE FOR WRAPPING A PRODUCT IN A SHEET OF HEAT-SEAL WRAPPING MATERIAL

(75) Inventors: Marco Ghini, S. Lazzaro di Savena; Mario Spatafora, Bologna, both of (IT)

(73) Assignee: G. D Societa'per Azioni, Bologna (IT)

( * ) Notice: Subject to any disclaimer, the term of this patent is extended or adjusted under 35 U.S.C. 154(b) by 0 days.

(21) Appl. No.: 09/345,132

(22) Filed: Jul. 6, 1999

(30) Foreign Application Priority Data

Jul. 8, 1998 (IT) ..... BO98A0419

(51) Int. Cl.[7] ..... B65B 51/10

(52) U.S. Cl. ..... 53/463; 53/477; 53/232; 53/234; 53/370.7; 53/371.6; 53/374.6; 53/586

(58) Field of Search ..... 53/463, 466, 461, 53/586, 203, 228, 230, 232, 233, 234, 370.7, 371.2, 371.6, 374.2, 374.6, 477, 373.5, 373.7, 371.7, 371.9

(56) References Cited

U.S. PATENT DOCUMENTS 3,984,963 * 10/1976 Seragnoli ..... 53/371.9
4,330,977 * 5/1982 Focke ..... 53/371.7
5,085,028 * 2/1992 Boriani et al. ..... 53/234
5,123,226 * 6/1992 Near ..... 53/234
5,410,858 * 5/1995 Osti et al. ..... 53/477
5,701,725 * 12/1997 Neri et al. ..... 53/466
5,794,413 * 8/1998 Draghetti ..... 53/466
5,839,253 * 11/1998 Draghetti ..... 53/234
6,000,199 * 12/1999 Boldrini ..... 53/466

FOREIGN PATENT DOCUMENTS 1489608 11/1967 (FR) .
2258187 2/1993 (GB) .

* cited by examiner

*Primary Examiner*—Peter Vo
*Assistant Examiner*—Louis Huynh
(74) *Attorney, Agent, or Firm*—Ladas & Parry

(57) ABSTRACT

A method and machine for wrapping a product in a sheet of heat-seal wrapping material, whereby the sheet of wrapping material is folded by a fixed folding device onto a wall of the product so as to superimpose at least two portions of the sheet of wrapping material; the sheet of wrapping material, once folded, is gradually released from the fixed folding device; and a sealing surface of a sealing head is brought gradually into a position facing the superimposed portions as the superimposed portions are gradually released from the folding device.

21 Claims, 9 Drawing Sheets

24
32
33
51
56
54
49
53
52
50
26
23
55
56
33
21
42
22
12
63
11
2
P
14
34
14
33
29
28
29
30
37
47
B
48
36
17
63
11
12
22
27
42
21
31
33
32
16
35
47
37
48
B
36

26
27
P
2
12
22
42
21
31
33
14
34
29
36
48
B
37
47
35
32
51
52
53
50
49
56
54
24
23
55
17
16

METHOD AND MACHINE FOR WRAPPING A PRODUCT IN A SHEET OF HEAT-SEAL WRAPPING MATERIAL

The present invention relates to a method of wrapping a product in a sheet of heat-seal wrapping material.

The present invention may be used to particular advantage on machines for cellophaning packets of cigarettes, to which the following description refers purely by way of example.

BACKGROUND OF THE INVENTION

On known machines for cellophaning packets of cigarettes, a sheet of heat-seal wrapping material is folded onto one wall of the product to superimpose two portions of the sheet of wrapping material by means of a folding device, which gradually releases the sheet of wrapping material once this is folded. When the folding device is fully detached from the wall of the product, a sealing surface of a sealing head is brought into contact with the superimposed portions of the sheet of wrapping material to seal and so stabilize the sheet of wrapping material in the folded configuration.

On known cellophaning machines of the above type, the two portions of the sheet of wrapping material folded one on top of the other against the wall of the product are left substantially free during the time interval between being released by the folding device and being engaged by the sealing surface. During which time, springback of the sheet of wrapping material may cause even a substantial alteration in the configuration of the sheet, thus impairing the quality of the finished wrapping.

SUMMARY OF THE INVENTION

It is an object of the present invention to provide a method of wrapping a product in a sheet of heat-seal wrapping material, designed to eliminate the aforementioned drawback, and which at the same time is both straightforward and cheap to implement.

According to the present invention, there is provided a method of wrapping a product in a sheet of heat-seal wrapping material, the method comprising the steps of causing said sheet of wrapping material to engage folding means for folding the sheet of wrapping material about said product to superimpose portions of the sheet. of wrapping material and obtain at least two superimposed portions; causing said sheet of wrapping material, once folded, to be released gradually from said folding means; and establishing contact between said superimposed portions and a sealing surface of a sealing head to seal the superimposed portions to each other; characterized in that said contact is established by bringing the sealing surface gradually into a position facing the superimposed portions as the superimposed portions are gradually released from the folding means.

The present invention also relates to a machine for wrapping a product in a sheet of heat-seal wrapping material.

According to the present invention, there is provided a machine for wrapping a product in a sheet of heat-seal wrapping material, the machine comprising folding means; first actuating means for causing said sheet of wrapping material to engage said folding means to fold the sheet of wrapping material about said product and superimpose portions of the sheet of wrapping material to obtain at least two superimposed portions, and for causing said sheet of wrapping material, once folded, to be released gradually from said folding means; a sealing head having a sealing surface; and second actuating means for establishing contact between said superimposed portions and said sealing surface to seal the superimposed portions to each other; characterized in that said second actuating means are so designed as to establish said contact by bringing the sealing surface gradually into a position facing the superimposed portions as the superimposed portions are gradually released from the folding means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
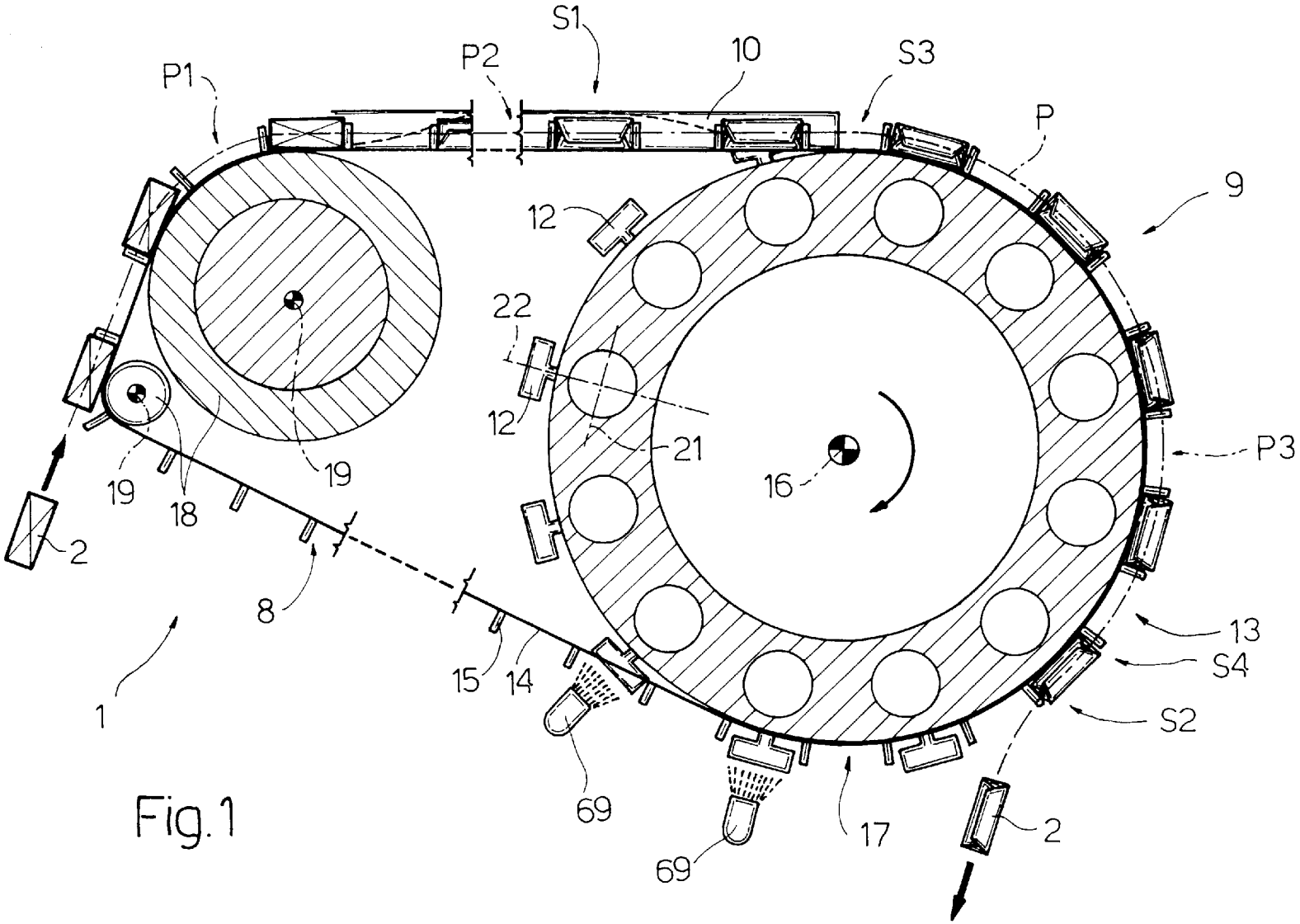
FIG. 1 shows a schematic, partial side view of a preferred embodiment of the machine according to the present invention.

Number 1 in FIG. 1 indicates a continuous cellophaning machine for overwrapping packets 2 of cigarettes in respective sheets 3 of heat-seal wrapping material, in particular polypropylene, having a melting temperature ranging between 90° C. and 140° C.

Figure 2:
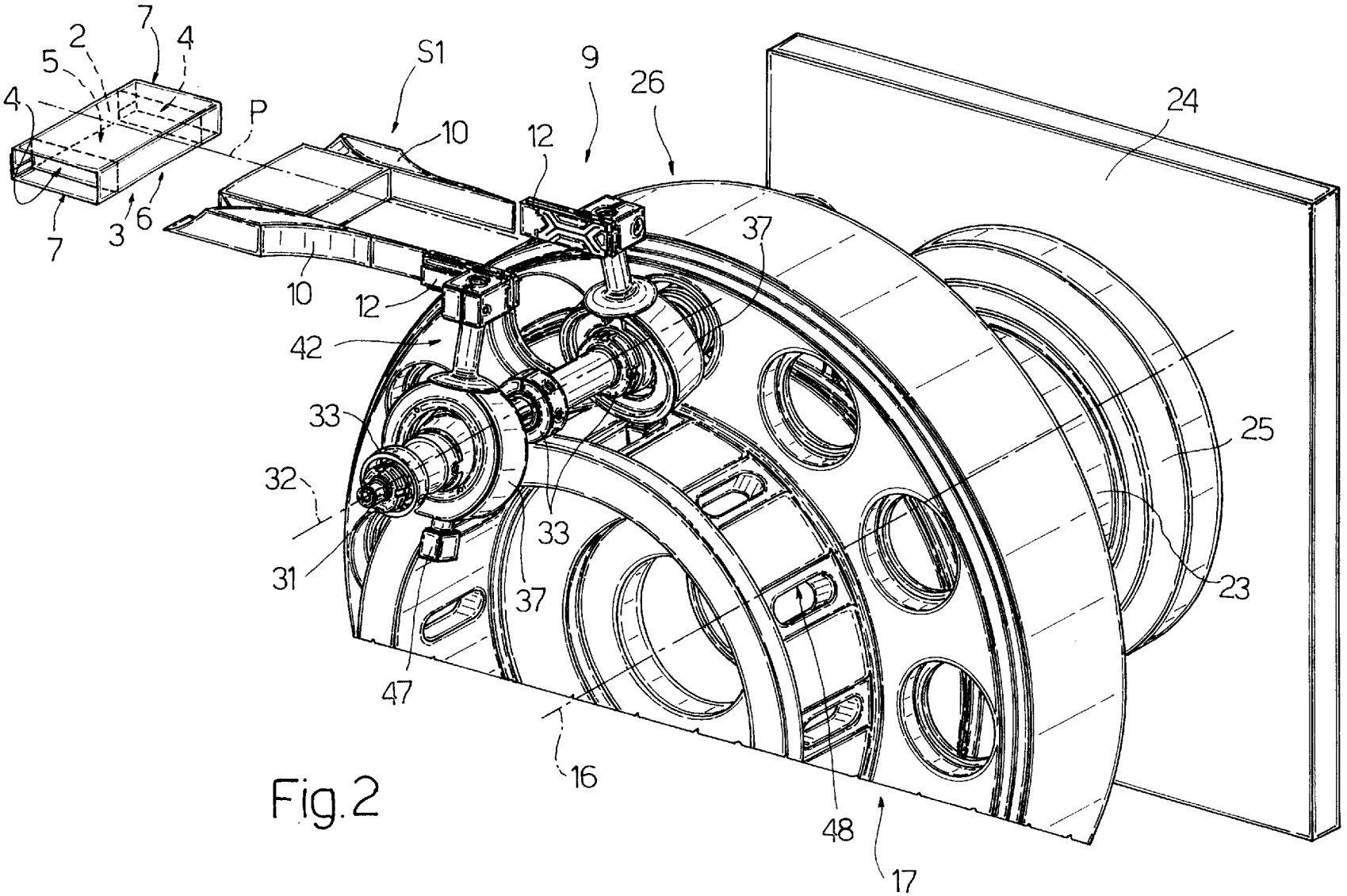
FIG. 2 shows a schematic view in perspective, with parts removed for clarity, of a sealing unit of the FIG. 1 machine.

As shown more clearly in FIG. 2, each packet 2 is substantially in the form of an elongated parallelepipedon, and comprises two opposite longitudinal end bases 4, and a lateral surface 5 perpendicular to bases 4.

On machine 1, packets 2 are fed through a known first section (not shown) where each packet 2 is assigned a respective sheet 3 of wrapping material, which is folded about packet 2 to define a tubular wrapping 6 stabilized by means of a longitudinal seal and having two opposite open ends 7 at bases 4.

From the known first section (not shown), packets 2 are fed to a conveyor 8, which feeds packets 2 along a wrapping path P lying in the FIG. 1 plane and extending through a second section 9 of machine 1.

Figure 12:
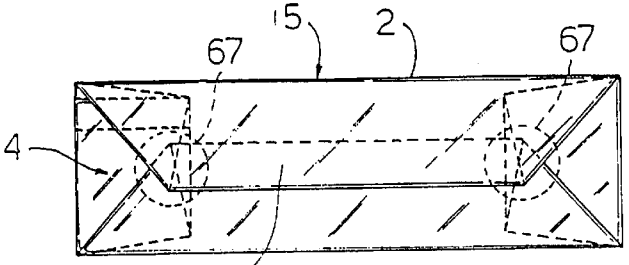
FIG. 12 shows a larger-scale view of the product processed by the FIG. 1 machine.

At section 9, conveyor 8, moving continuously, feeds each packet 2 along wrapping path P and through a folding station S1 where each open. end 7 of tubular wrapping 6 is engaged by a respective fixed helical folding device 10 and is closed by folding portions 11 (FIG. 12) of end 7 one on top of the other onto respective base 4 of packet 2.

Once open ends 7 are closed, the superimposed portions 11 of both ends 7 of each packet 2 are engaged simultaneously by respective sealing heads 12 of a respective pair of sealing heads 12 of a sealing unit 13 to stabilize sheet 3 of wrapping material in the folded configuration about packet 2.

As shown in FIG. 1, wrapping path P terminates at a known transfer station S2 where the overwrapped packets 2 are transferred to a known output section (not shown) of machine 1.

Conveyor 8 comprises a pair of parallel toothed belts 14 (only one shown in FIG. 1) comprising projections 15 spaced with a given spacing and for engaging and feeding packets 2 along wrapping path P. which comprises a straight initial portion P1, a downstream straight portion P2 connected to portion P1 by a curved portion, and a circular end portion P3 extending about an axis 16 perpendicular to the FIG. 1 plane.

Along circular portion P3, each belt 14 extends about a wheel 17 powered to rotate continuously about axis 16 and supporting sealing unit 13, the pairs of heads 12 of which are equally spaced about axis 16.

At the opposite ends of portion P1, each belt 14 extends about a pair of idle transmission rollers 18 rotating about respective axes 19 parallel to axis 16. Folding station Si is located along straight portion P2. In particular, the two fixed helical folding devices 10 are located on either side of wrapping path P to engage respective open ends 7 of each tubular wrapping 6.

As wheel 17 rotates about axis 16, each pair of sealing heads 12 is fed along part of wrapping path P in time with a respective packet 2, and the sealing heads 12 in each pair of heads 12 are positioned facing each other to simultaneously engage respective opposite ends 7 of a respective tubular wrapping 6, which is engaged by heads 12 at an input station S3 at the end of folding devices 10, and is released from heads 12 at an output station S4 upstream from station S2.

Figure 4:
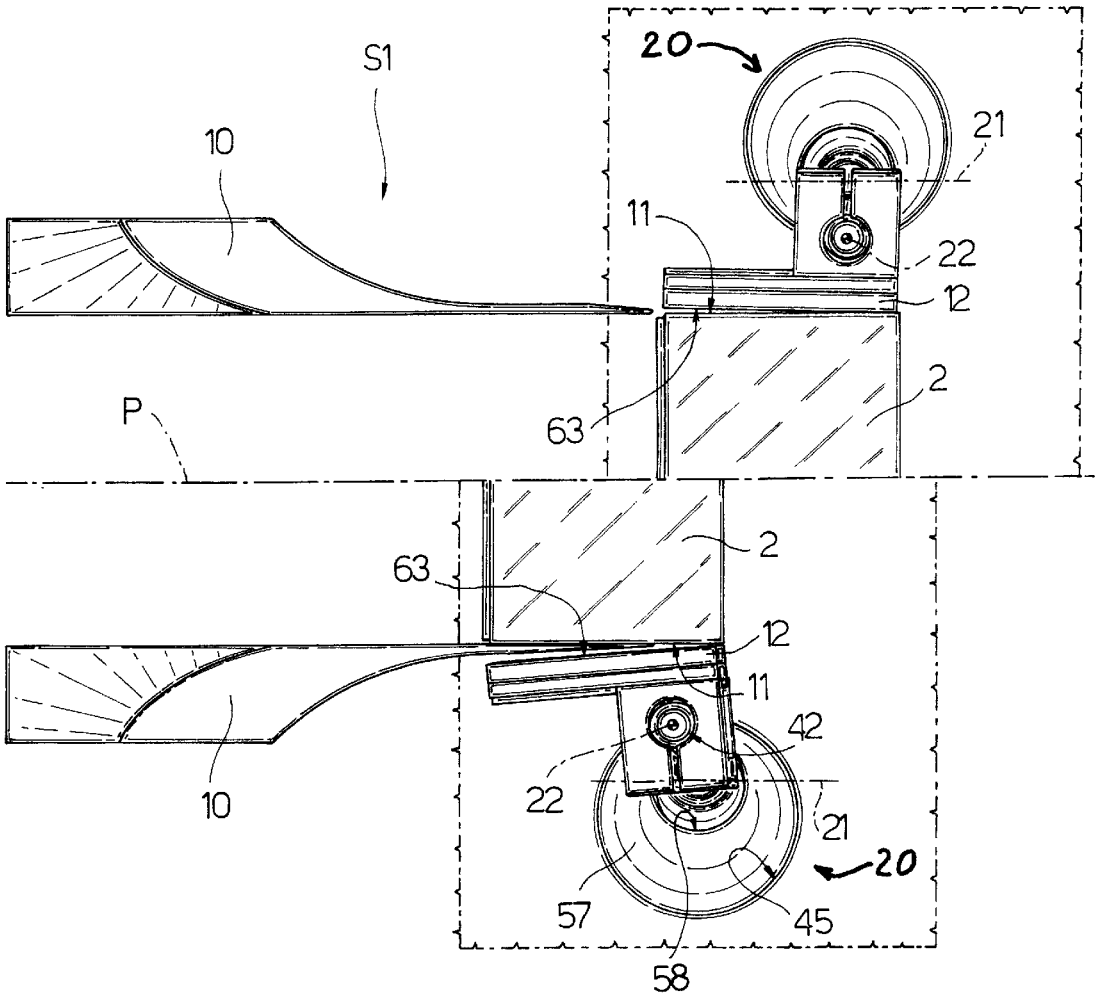
FIG. 4 shows a schematic plan view of a second detail of the FIG. 2 unit in two different operating positions.

As shown in FIG. 4, each sealing head 12 engages respective portions 11 gradually as portions 11 are released from respective folding device 10 and by virtue of a respective actuating device 20, which causes each sealing head 12 in each pair of heads 12 to oscillate, with respect to wheel 17, about an axis 21 parallel to wrapping path P, and at the same time to oscillate about an axis 22, which in turn oscillates about axis 21 together with respective sealing head 12, while remaining perpendicular at all times to axis 21. As explained in detail in the following description, the above operating mode prevents any change in configuration caused by springback of the newly folded superimposed portions 11 pending stabilization by sealing.

Figure 5:
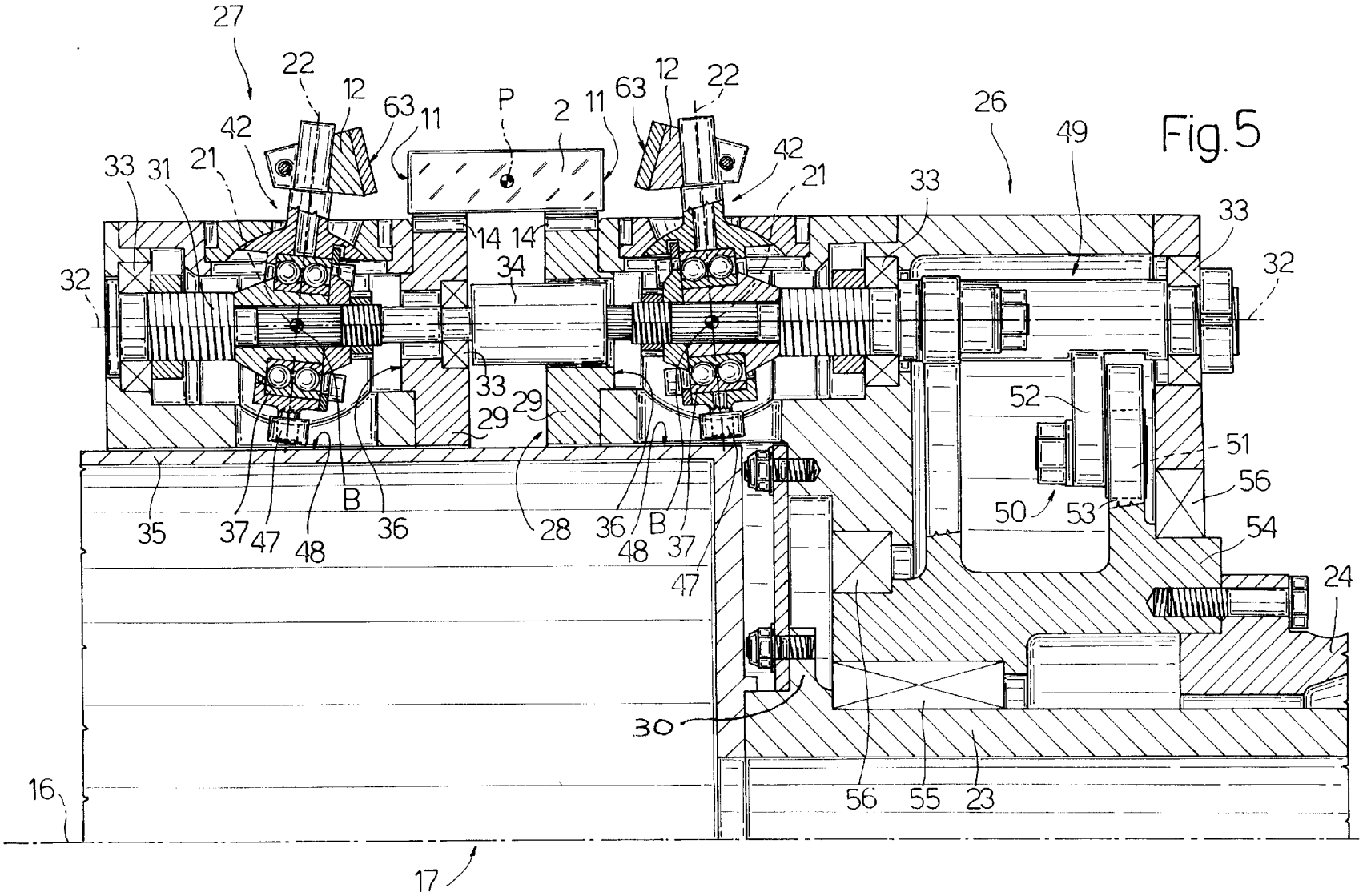
FIGS. 5 and 6 show sections of the FIG. 2 unit in two different operating positions.

As shown in FIGS. 2 and 5, wheel 17 is supported by and connected angularly to a powered tubular shaft 23, which is coaxial with axis 16 and in turn fitted in rotary mariner to a frame 24 by means of ball bearings 25 (only one shown in FIG. 2).

Wheel 17 comprises two annular portions 26 and 27, which are positioned facing each other, are coaxial with axis 16, are located on opposite sides of wrapping path P, and are separated by a given distance to define, in between, a chamber 28 partly engaged by two ring gears 29, each of which is fitted to a respective annular portion 26, 27 and is connected to a respective belt 14 of conveyor 8.

As shown in FIG. 5, portion 26 is bolted integrally and coaxially to a flange 30 of shaft 23, and is connected angularly to portion 27 via the interposition of a number of shafts 31, each of which is fitted to portions 26 and 27 by means of respective ball bearings 33 so as to rotate about a respective axis 32 parallel to axis 16.

Each shaft 31 is divided into two functionally identical parts, each of which is housed in a respective annular portion 26, 27 and is connected to the other part by a joint 34 housed inside chamber 28 and for adjusting the axial distance between the two parts of shaft 31 to different formats.

As shown in FIG. 5, the free end of shaft 23 is fitted integrally with a cylindrical bell 35 coaxial with and defining the inner core of wheel 17.

A respective chamber 36 is defined in each portion 26, 27, is open outwards, and is closed on one side by respective ring gear 29 and on the other by a respective bearing 33.

Figure 7:
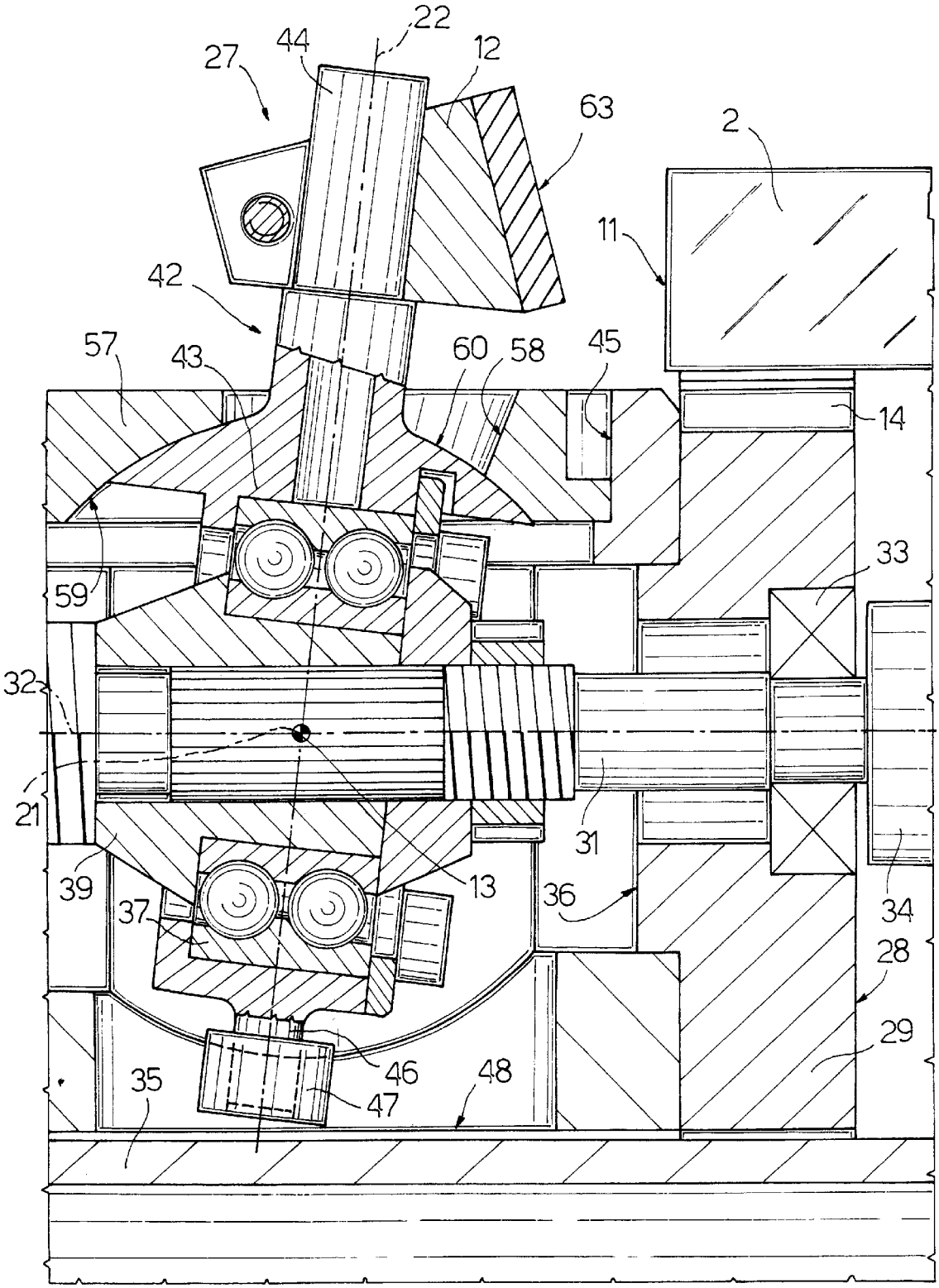
FIG. 7 shows a larger-scale view of a detail in FIG. 5.
Figure 8:
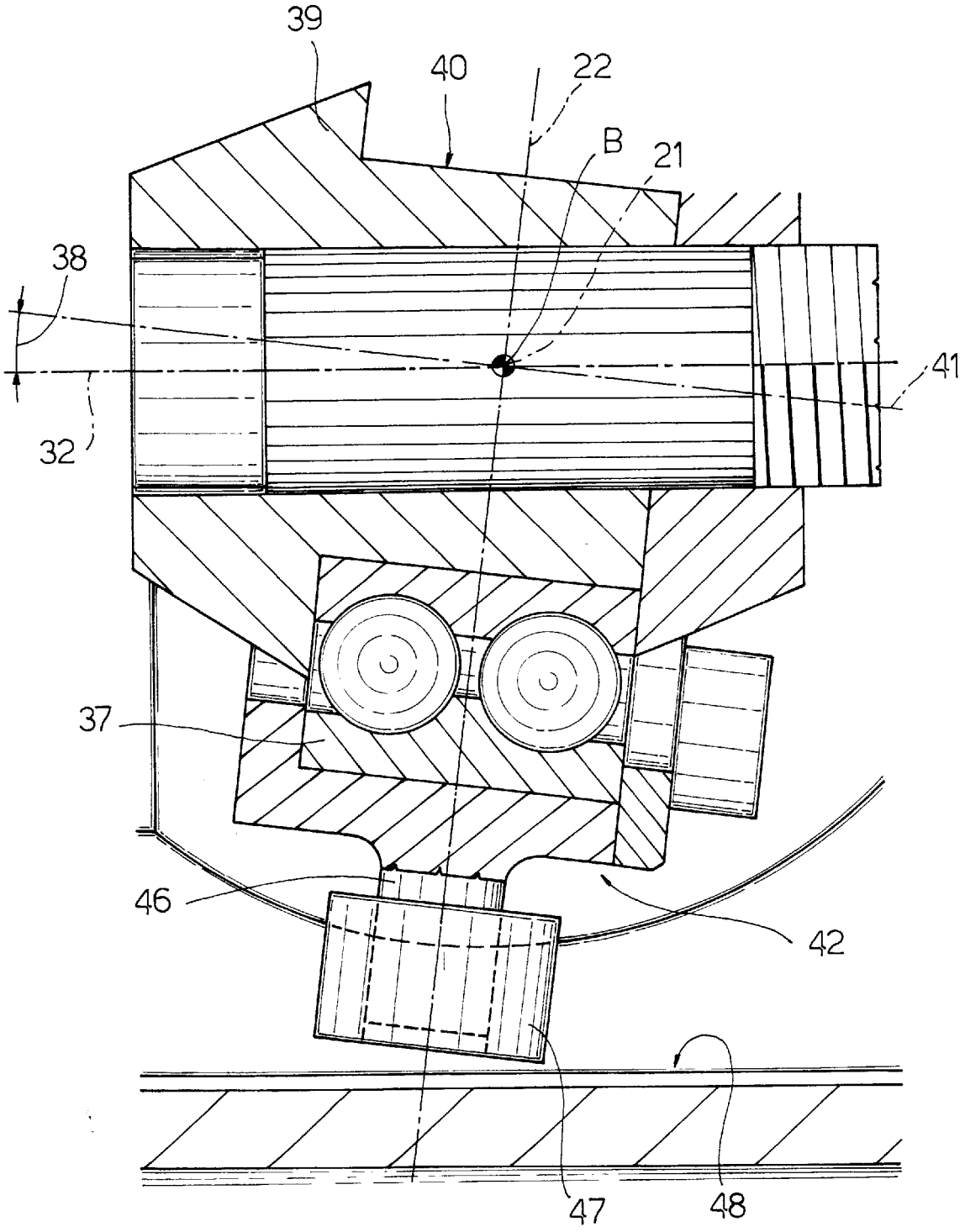
FIG. 8 shows a larger-scale view of a detail in FIG. 7.

As shown more clearly in FIGS. 7 and 8, each chamber 36 houses a ball bearing 37, which is fitted to respective shaft 31 at a given tilt angle 38 via the interposition of a tubular body 39 having a cylindrical outer surface 40, the axis 41 of which forms angle 38 with axis 32, and which is fitted with an inner ring of bearing 37. Each bearing 37 is fitted to respective shaft 31 so that the center of gravity B of bearing 37 lies along respective axis 32.

Each chamber 36 also houses a bar 42 comprising an annular intermediate portion 43 fitted to respective bearing 37; a first outer end portion 44 projecting from chamber 36 through a cylindrical opening 45 in chamber 36, and the free end of which supports a respective sealing head 12; and a second inner end portion 46 housed inside chamber 36 and supporting a tappet roller 47, which engages a corresponding track 48 defined in portion 26, 27 and perpendicular to wrapping path P and parallel to axis 16.

For each head 12, respective axis 21 is perpendicular to respective axis 32, which axis 21 intersects at the center of gravity B of respective bearing 37; and respective axis 22 is coaxial with respective bar 42 and perpendicular to axis 21, which axis 22 intersects at the center of gravity B of respective bearing 37.

As shaft 31 oscillates about respective axis 32, the two opposite ends of bar 42 would oscillate about two opposed cones with the respective vertices at center of gravity B of respective bearing 37, if they were not forced by track 48 to oscillate, by amounts proportional to angle 38, about axis 21 and in the same plane oriented radially with respect to axis 16 and defined by axis 16 itself and by respective track 48.

As it oscillates about axis 21, bar 42 is guided by track 48 so as to simultaneously rotate about axis 22, which rotation is transmitted, together with said oscillation about axis 21, to respective sealing head 12.

Each actuating device 20 comprises a cam control device 49 for oscillating respective shaft 31 about axis 32 as wheel 17 rotates about axis 16.

Each control device 49 comprises a follower device 50 having two rollers 51, each of which is fitted idly to the end of a respective arm 52 extending radially outwards from the periphery of shaft 31 to engage two fixed coaxial annular cams 53 extending about axis 16. The two arms 52 are axially offset along shaft 31 and angularly offset about axis 32 so as to "ride" an assembly defined by the two integral cams 53 and permit positive control of oscillation of shaft 31 about axis 32.

Figure 6:
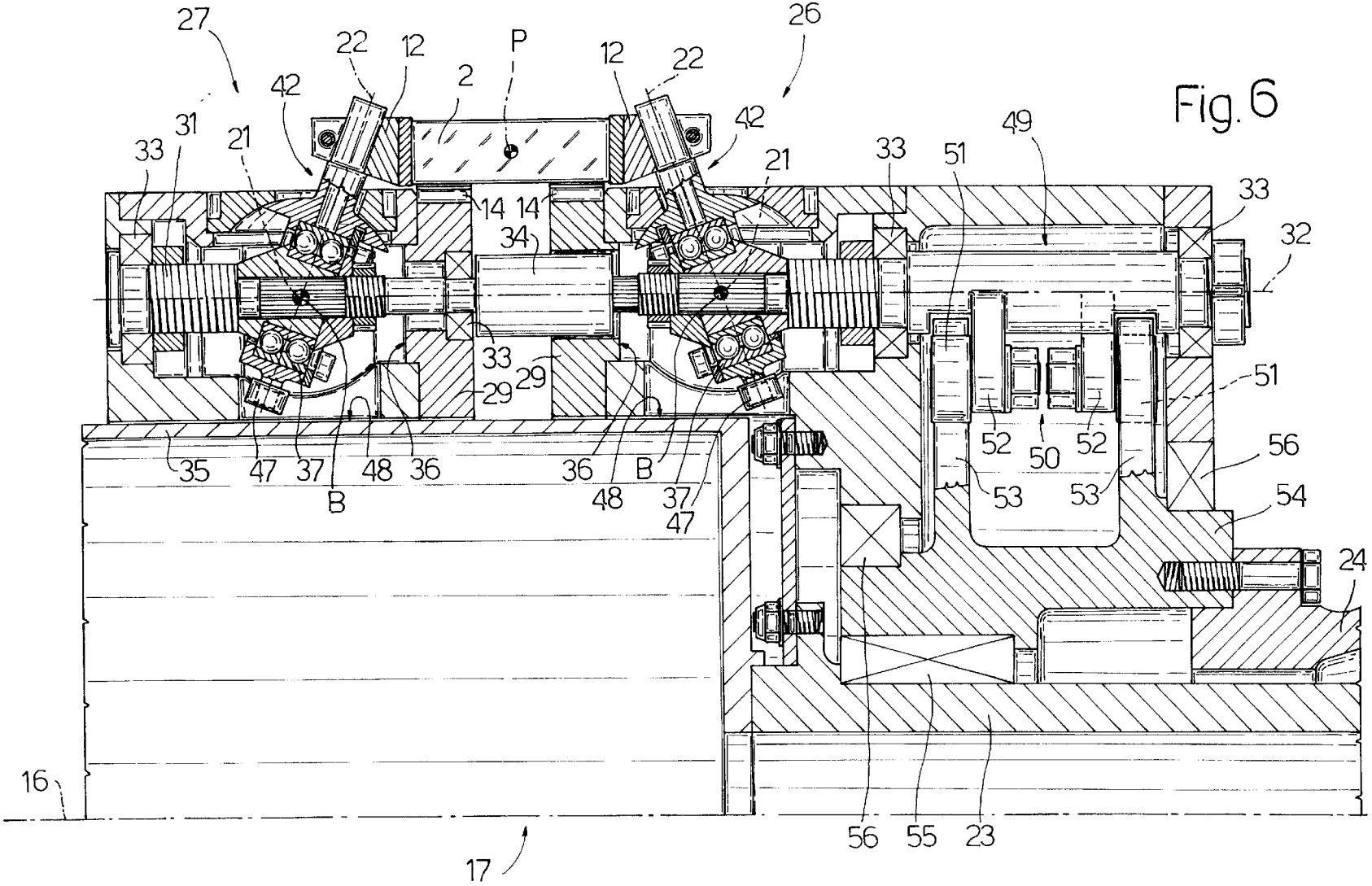

The assembly defined by the two cams 53 substantially comprises a fixed sleeve 54, which carries the two cams 53 externally, is fitted through with shaft 23, and is made integral with frame 25 by means of a number of bolts (only one shown in FIGS. 5 and 6). Sleeve 54 is connected in rotary manner to shaft 23 by means of an inner ball bearing 55, and aids in supporting annular portion 26 of wheel 17 by means of two outer ball bearings 56.

Cylindrical opening 45 of each chamber 36 is closed by a metal hood 57 having a truncated-cone-shaped central hole 58 fitted through with outer end portion 44 of respective bar 42. To ensure an airtight seal between bar 42 and hood 57, hood 57 is defined internally by a spherical surface 59 cooperating with an outer portion, defined externally by a spherical surface 60, of annular intermediate portion 43.

Figure 11A:
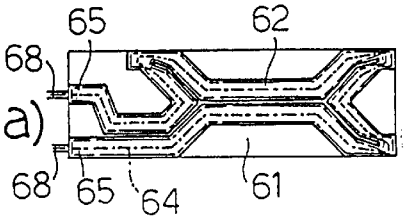
FIGS. 11*a*–11*c* shows a plan view, FIGS. 11(*b*) and 11(*c*) show two variations of the FIG. 9 detail.
Figure 9:
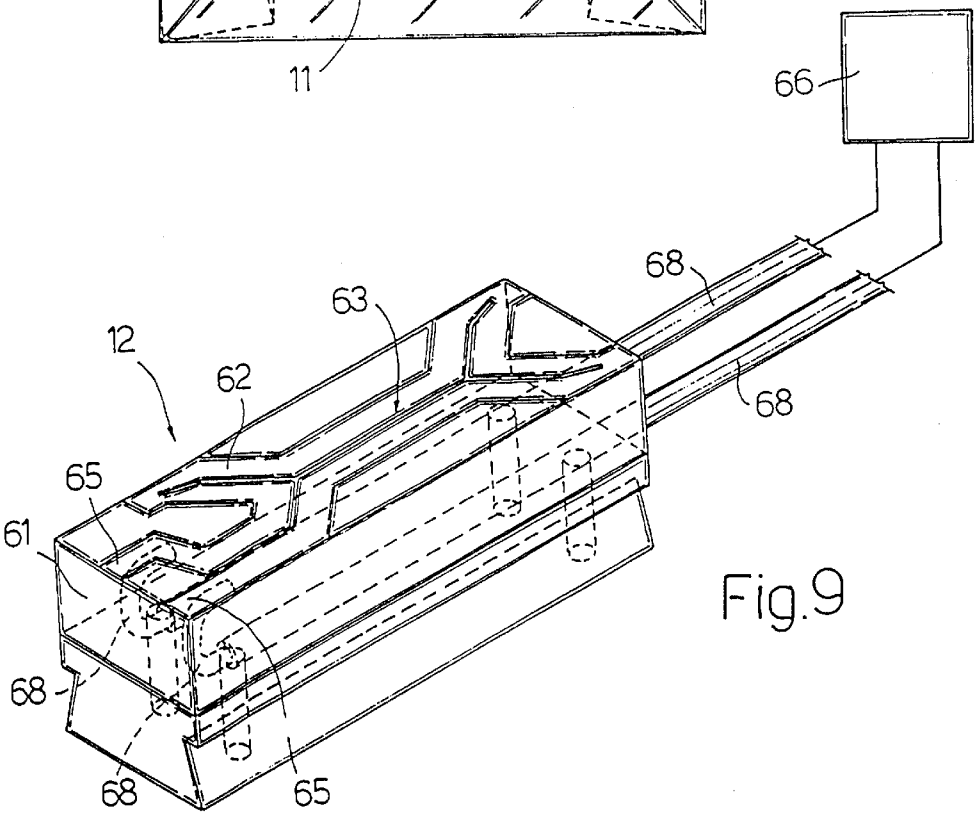
FIG. 9 shows a larger-scale view in perspective of a third detail of the FIG. 2 unit.

As shown more clearly in FIGS. 9 and 11*a*, each sealing head 12 comprises a supporting pad 61 made of thermally insulating material (in particular, silicone rubber); and a plate 62 fitted to pad 61 and made of electrically and thermally conductive material (in particular, metal). Plate 62 defines a sealing surface 63, and comprises a strip extending along a work path 64 having two ends 65.

Sealing unit 13 also comprises a control device 66 (shown schematically in FIG. 9) in turn comprising, for each sealing head 12, a known electric generator (not shown) connected electrically to the two ends 65 to circulate alternating or direct electric current of adjustable intensity along plate 62 and work path 64.

In a preferred embodiment, each known electric generator (not shown) comprises a measuring unit for determining the total electric resistance of plate 62 by measuring the voltage and current values between ends 65, and for determining, according to said resistance, the temperature of plate 62 and therefore of sealing surface 63.

In an alternative embodiment not shown, control device 66 comprises a number of temperature sensors (in particular, thermocouples), each associated with a respective sealing head 12 to determine the temperature of sealing surface 63 of respective plate 62.

Control device 66 controls the known electric generator (not shown) to regulate the intensity of the electric current along each plate 62 according to the temperature of sealing surface 63, and to keep the temperature of sealing surface 63 equal to a given value at all times.

Figure 11B:
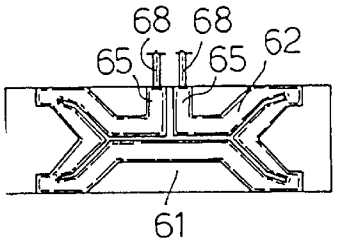
Figure 11C:
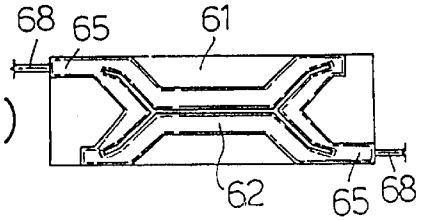

As shown in the various embodiments in FIGS. 11*a*, 11*b*, and 11*c* , work path 64 is so formed as to reproduce the layout of the superimposed portions of sheet 3 of wrapping material (as shown by comparing FIGS. 9 and 10) and so concentrate the heat produced by plate 62 solely on the overlapping portions of sheet 3.

In an alternative embodiment, the section area of plate 62 varies along work path 64. In particular, the area of each cross section of plate 62 varies in inverse proportion to the total thickness of the heat-seal material with which, in use, the section is brought into contact. That is, at the maximum total thickness portions of the heat-seal material (indicated 67 by way of example in FIG. 12), the corresponding cross sections of plate 62 are smaller in area, so that the electric resistance of plate 62 at said sections is greater and, by virtue of the Joule effect, plate 62 produces more heat.

In particular, the thickness of plate 62 is constant, and the width of plate 62 is varied, as shown in FIGS. 11*a*–11*c*, to vary the section of plate 62.

In a preferred embodiment, the known electric generator (not shown) generates a succession of electric current pulses of adjustable intensity and frequency.

Figure 10:
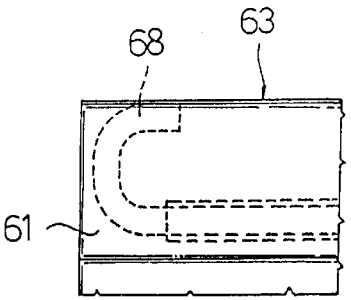
FIG. 10 shows a schematic view of a portion of the FIG. 8 detail.

As shown in FIGS. 9 and 10, the conductors 68 connecting ends 65 to the known electric generator (not shown) are embedded in pad 61.

Control device 66 also comprises a cooling device 69, which is located in a fixed position with respect to wheel 17, provides for cooling sealing surfaces 63, and is defined by respective ventilators, each for blowing air onto respective sealing surface 63.

Operation of cellophaning machine 1 will now be described with reference to one packet 2, and as of the instant in which packet 2, enclosed in a respective sheet 3 of wrapping material folded to form a tubular wrapping 6 having two opposite open ends 7, is fed to conveyor 8.

As shown in FIG. 1, conveyor 8 feeds packet 2 continuously along wrapping path P and through folding station Si where each open end 7 of tubular wrapping 6 is engaged by a respective fixed helical folding device 10 and folded onto respective base 4 of packet 2 to superimpose portions 11 (FIG. 12) of end 7.

Figure 3:
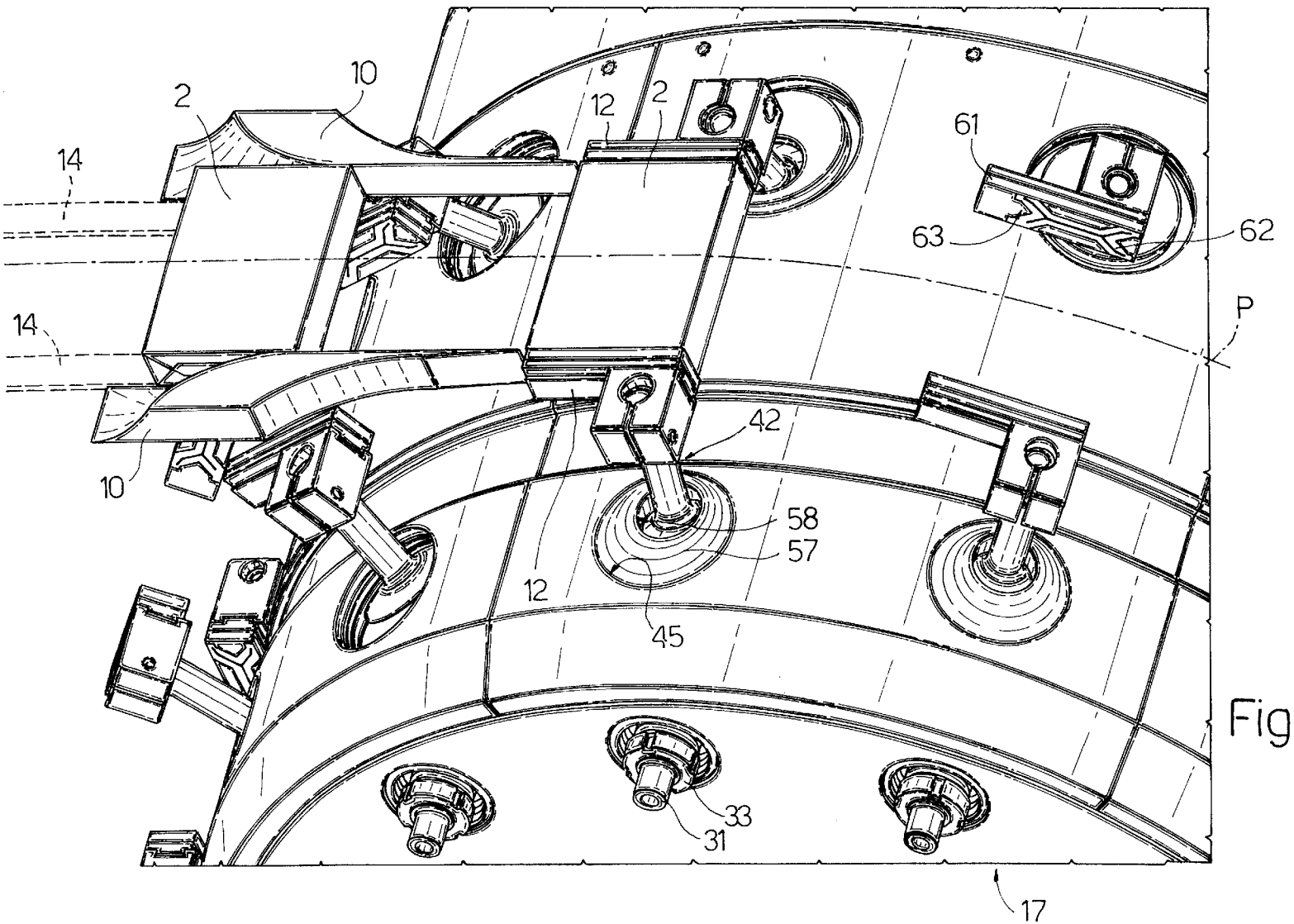
FIG. 3 shows a larger-scale view in perspective of a first detail of the FIG. 2 unit.

As shown more clearly in FIGS. 3 and 4, ends 7, once released from respective folding devices 10, are engaged simultaneously by respective sealing heads 12 of a respective pair of heads 12 to seal and so stabilize superimposed portions 11.

Contact between each sealing surface 63 and relative superimposed portions 11 is established by bringing sealing surface 63 gradually into a position facing superimposed portions 11 as superimposed portions 11 are released from respective folding device 10.

As already described, each sealing surface 63 is brought gradually into a position facing relative superimposed portions 11 by oscillating respective sealing head 12, with respect to wheel 17, about axis 21 and simultaneously about axis 22. As a result of the above two oscillations and the rotation of wheel 17 about axis 16, each sealing surface 63 is gradually brought to rest (FIG. 4) on relative superimposed portions 11, commencing with the edge of the sealing surface located at the front in the rotation direction of wheel 17 and, upon initial contact with relative superimposed portions 11, immediately downstream from respective folding device 10 in the traveling direction of packets 2.

Each sealing surface 63 remains in contact with relative superimposed portions 11 along a portion of wrapping path P extending more than 90° about axis 16, from input station S3 to output station S4; and control device 66 controls the known electric generator (not shown) and cooling device 69 so that the temperature of sealing surface 63 equals a lead-in value T1 (actually equal to about 80° C.) upon sealing surface 63 first contacting sheet 3 of wrapping material, and is later increased to a work value T2 (actually equal to about 130° C.) to seal the superimposed portions 11 of respective end 7.

Each sealing head 12 is therefore fed cyclically and continuously along an endless sealing path extending about axis 16 and through input station S3, where sealing head 12 engages a respective packet 2 to establish contact between respective sealing surface 63 and said superimposed portions, and output station S4, where sealing head 12 releases packet 2 to break off contact. Control device 66 provides for increasing the temperature of each sealing surface 63 from value T1 to value T2 as respective head 12 travels from input station S3 to output station S4, and for restoring the temperature of each sealing surface 63 to value T1 as respective sealing head 12 travels from output station S4 to input station S3.

As shown in FIG. 1, wrapping path P terminates at a known transfer station S2 where the overwrapped packet 2 is transferred to a known output section (not shown) of machine 1.

On cellophaning machine 1, each sealing surface 63 is therefore brought into contact with a respective sheet 3 of wrapping material at a relatively low temperature (lead-in temperature T1) to prevent any creasing and/or undulation of sheet 3.

Heating and subsequent cooling of sealing surfaces 63 during operation of cellophaning machine 1 are made possible by the very low thermal inertia of plates 62.

What is claimed is:

1. A method of wrapping a product in a sheet of heat-seal wrapping material, the method comprising the steps of causing said sheet (3) of wrapping material to engage folding means (10) for folding the sheet (3) of wrapping material about said product (2) to superimpose portions (11) of the sheet (3) of wrapping material and obtain at least two superimposed portions (11); causing said sheet (3) of wrapping material, once folded, to be released gradually from said folding means (10); and establishing contact between said superimposed portions (11) and a sealing surface (63) of a sealing head (12) to seal the superimposed portions (11); wherein said contact is established by bringing the sealing surface (63) gradually into a position facing the superimposed portions (11) as the superimposed portions (11) are gradually released from the folding means (10); said product (2) being fed, together with said sheet (3) of wrapping material, along a wrapping path (P); said folding means (10) being located in a fixed position with respect to the folding path (P) in time with said product (2); said sealing surface (63) being brought gradually into a position facing said superimposed portions (11) by means of a first oscillation of the sealing head (12) about a first axis (21) parallel to said wrapping path (P), and a simultaneous second oscillation of the sealing head (12) about a second axis (22), which oscillates about the first axis (21) together with the sealing head (12) while remaining perpendicular to the first axis (21); and said first axis (21) being fed along said portion (P3) of the wrapping path (P) in time with said sealing head (12).

2. A method as claimed in claim 1, wherein said first oscillation moves said sealing head (12) in a direction perpendicular to said wrapping path (P).

3. A method as claimed in claim 1, wherein said contact between said superimposed portions (11) and said sealing surface (63) is maintained for a given interval of time; the temperature of said sealing surface (63) being set to a first lead-in work value (T1) upon said contact, and being increased to a second work value (T2) during said given interval of time.

4. A method as claimed in claim 3, wherein the temperature of the sealing surface (63) is restored to said first value (T1) upon said contact being cut off.

5. A method as claimed in claim 3, wherein said sealing head (12) is fed cyclically and continuously along an endless sealing path comprising an input station (S3) where the sealing head (12) engages said product (2) to establish said contact between said sealing surface (63) and said superimposed portions (11), and an output station (S4) where the sealing head (12) releases said product (2) to cut off said contact.

6. A method as claimed in claim 5, wherein the temperature of said sealing surface (63) is increased from said first value (T1) to said second value (T2) as said sealing head (12) is fed from said input station (S3) to said output station (S4), and is restored to said first value (T1) as said sealing head (12) is fed from said output station (S4) to said input station (S3).

7. A machine for wrapping a product in a sheet of heat-seal wrapping material, the machine comprising folding means (10); first actuating means (8) for causing said sheet (3) of wrapping material to engage said folding means (10) to fold the sheet (3) of wrapping material about said product (2) and superimpose portions (11) of the sheet (3) of wrapping material to obtain at least two superimposed portions (11), and for causing said sheet (3) of wrapping material, once folded, to be released gradually from said folding means (10); a sealing head (12) having a sealing surface (63); and second actuating means (17, 20) for establishing contact between said superimposed portions (11) and said sealing surface (63) to seal the superimposed portions (11) to wherein said second actuating means (17, 20) is so designed as to establish said contact by bringing the sealing surface (63) gradually into a position facing the superimposed portions (11) as the superimposed portions (11) are gradually released from the folding means (10); said machine further comprising control means (66) for controlling the temperature of said sealing surface (63) so as to set the temperature of the sealing surface (63) to a first lead-in work value (T1) upon said contact being established between the sealing surface (63) and said superimposed portions, and to increase the temperature of the sealing surface (63) to a second work value (T2) during a time interval in which the sealing surface (63) is in contact with said superimposed portions (11).

8. A machine as claimed in claim 7, wherein said first actuating means (8) feed said product (2), together with said sheet (3) of wrapping material, along a wrapping path (P); said folding means (10) being located substantially tangent to said wrapping path (P) and in a fixed position with respect to said machine (1).

9. A machine as claimed in claim 8, wherein said second actuating means (17,20) comprise a conveyor (17) for feeding said sealing head (12) along a portion (P3) of said wrapping path (P) in time with said product (2).

10. A machine as claimed in claim 9, wherein said sealing head (12) is fitted to said conveyor (17) to oscillate with respect to the conveyor (17) about a first axis (21) parallel to said wrapping path (P), and to oscillate about a second axis (22), which oscillates about the first axis (21) together with the sealing head (12) while remaining perpendicular to the first axis (21).

11. A machine as claimed in claim 10, wherein said second actuating means (17,20) comprise an actuating device (20) for controlling oscillation of said sealing head (12) about said first and second axes (21,22) ; said actuating device (20) comprising a bar (42) coaxial with said second axis (22) and supporting said sealing head (12) at one end (44) and a tappet roller (47) at an opposite end (46); a shaft (31) rotating about a third axis (32) perpendicular to said first axis (21); a ball bearing (37) supporting said bar (42) and fitted to said shaft (31) at a given tilt angle (38); and a track (48) engaged by said tappet roller (47) to guide rotation of said bar (42) about said first axis (21) in a plane perpendicular to said wrapping path (P).

12. A machine as claimed in claim 11, wherein said actuating device (20) comprises a cam control system (49) for oscillating said shaft (31) about s aid third axis (32).

13. A machine as claimed in claim 12, wherein said conveyor (17) comprises a wheel (17) powered to rotate about a central fixed fourth axis (16) parallel to said third axis (32) and crosswise to said first axis (21) and said wrapping path (P).

14. A machine as claimed in claim 13, wherein said first actuating means (8) comprise a conveyor belt (9) extending along said wrapping path (P) and about said wheel (17).

15. A machine as claimed in claim 7, wherein said control means (66) comprise a heating device (62) for increasing the temperature of said sealing surface (63); and a cooling device (69) for reducing the temperature of said sealing surface (63).

16. A machine as claimed in claim 15, wherein said heating device (62) comprises an electric resistor (62); and said cooling device (69) comprises a ventilation device (69) for blowing air onto said sealing surface (63).

17. A machine for wrapping a product in a sheet of heat-seal wrapping material, the machine comprising folding means (10); first actuating means (8) for causing said sheet (3) of wrapping material to engage said folding means (10) to fold the sheet (3) of wrapping material about said product (2) and superimpose portions (11) of the sheet (3) of wrapping material to obtain at least two superimposed portions (11), and for causing said sheet (3) of wrapping material, once folded, to be released gradually from said folding means (10); a sealing head (12) having a sealing surface (63); and second actuating means (17, 20) for establishing contact between said superimposed portions (11); said second actuating means (17, 20) establishing said contact by bringing the sealing surface (63) gradually into a position facing the superimposed portions as the superimposed portions (11) are gradually released from the folding means (10); said sealing head (12) comprising a supporting pad (61) made of thermally insulating material; and a plate (62) which is fitted to said pad (61), is made of electrically and thermally conductive material, defines said sealing surface (63), and comprises a strip extending along a work path (64) having two ends (65); said machine further comprising control means (66) comprising an electric generator connected to said two ends (65) to circulate electric current along said plate (62) and said work path (64).

18. A machine as claimed in claim 17, wherein said control means (66) comprise a measuring unit for determining the temperature of said plate (62) by determining the electric resistance value of said plate (62) between said two ends (65); said control means (66) controlling said electric generator to regulate the intensity of said electric current along the plate (62) according to the temperature of the plate (62).

19. A machine as claimed in claim 17, wherein said work path (64) reproduces a layout of superimposed areas (11,67) of portions of the sheet (3) of wrapping material.

20. A machine as claimed in claim 17, wherein said plate (62) comprises a cross section, the area of which varies from one point to another of said work path (64); the area of each cross section of the plate (62) being inversely proportional to a total thickness of the heat-seal material with which, in use, said cross section is brought into contact.

21. A machine as claimed in claim 20, wherein said plate (62) is of constant thickness and varies in width from one point to another of said work path (64).

* * * * *